United States Patent [19]

Wuthrich

[11] 4,157,646

[45] Jun. 12, 1979

[54] ALARM SWITCH AND ALARM SET DEVICE

[75] Inventor: Paul Wuthrich, Watertown, Conn.

[73] Assignee: Timex Corporation, Waterbury, Conn.

[21] Appl. No.: 861,590

[22] Filed: Dec. 19, 1977

[51] Int. Cl.[2] ..... G04C 21/16

[52] U.S. Cl. ..... 58/19 B; 58/16 R; 58/16 D; 58/19 A; 58/57.5

[58] Field of Search ..... 58/16 R, 16 D, 19 R–19 B, 58/57.5, 152 B

[56] References Cited

U.S. PATENT DOCUMENTS

| | | | |
|---|---|---|---|
| 327,919 | 10/1885 | Burmann | 58/19 B |
| 1,521,600 | 1/1925 | Crowe | 58/19 A |
| 1,529,852 | 3/1925 | Tanglin | 58/57.5 |
| 3,775,967 | 12/1973 | Spadini | 58/57.5 |
| 3,832,843 | 9/1974 | Wuthrich | 58/57.5 |
| 3,845,614 | 11/1974 | Christ | 58/19 A |
| 3,910,034 | 10/1975 | Tilse | 58/152 B |

*Primary Examiner*—Ulysses Weldon
*Attorney, Agent, or Firm*—Lawrence Hager

[57] ABSTRACT

An electric alarm timepiece includes an alarm switch and alarm time set device wherein the alarm ringing circuit is closed when the hour hand contacts an alarm set indicator/switch contact extending above the tip of the hour hand. The outer portion or tip of the hour hand is guided by a formed ridge on an alarm set insulator ring and moves about the inner periphery of the insulator ring, thereby assuring proper contact closure with the alarm set indicator/switch contact. The alarm set indicator/switch contact is mounted at one end to a rotatable crystal and is rotatable therewith for purposes of setting. The crystal is rotatably mounted on the timepiece housing by means of a slip ring which provides spring pressure against the crystal to thereby hold the crystal in rotatable engagement with a face plate or the housing member and provides function under spring pressure from the slip ring contacts to enable electrical connection between the alarm set indicator/switch contact and the internal alarm circuitry. Ridges on the alarm set insulator ring assure the alignment of the alarm set indicator and the tip of the hour hand to insure switch contact.

6 Claims, 8 Drawing Figures

ALARM SWITCH AND ALARM SET DEVICE

BACKGROUND OF THE INVENTION

The present invention relates to an alarm setting device and switch activating means for a timepiece.

Alarm clocks, alarm clock devices, and alarm wristwatches are well known. The alarm mechanism is generally activated by closing a switch at the predetermined alarm time. One contact of the switch may be the hour hand or a separate hour wheel which rotates about the dial. The outer switch contact may comprise, for example, a ring or separate contact element which may be rotated to set the desired alarm time. After setting, this latter contact remains stationary and is connected by the moving contact means to activate the alarm mechanism.

Typical problems encountered in the prior art alarm timepieces are switch reliability, difficulty of setting the alarm mechanism, complexity and cost of alarm switch and setting mechanism.

Among the more pertinent prior art disclosures are Spadini U.S. Pat. Nos. 3,577,876 issued May 11, 1971, 3,611,702 issued Oct. 12, 1971 and 3,638,418 issued Feb. 1, 1972, other references include U.S. Pat. No. 3,596,460 issued Aug. 3, 1971 to Paul Wuthrich, U.S. Pat. No. 3,832,843 issued Sept. 3, 1974 to Paul Wuthrich, U.S. Pat. No. 3,977,177 issued Aug. 31, 1976 to Joseph Egger and U.S. Pat. No. 3,910,034 issued Oct. 7, 1975 to Wilhelm Paul Tilse.

In contrast to the prior art, the present invention provides a device having a simple, robust and relatively inexpensive structure which combines the capabilities and advantages of direct manual actuation and setting of the alarm indicator and switch, is adapted for ease of use and involves a minimum of associated parts.

It is, of course, to be understood that the prior art references mentioned above are not intended to be an all-inclusive list of the relevant prior art and other patents/references may exist which are pertinent.

SUMMARY OF THE INVENTION

The present invention relates to an electric alarm timepiece having an on-off switch wherein contact closure is produced by surface contact between the hour hand and the alarm set indicator. The tip or contact portion of the hour hand rotates above a ridge on the inner peripheral surface of an alarm set insulator ring and insures positive contact with the alarm set indicator which is positioned above the hour hand. The alarm set indicator is mounted on its outer end to the alarm set ring and extends inwardly therefrom to make contact with the upper contact surface of the hour hand. The alarm set ring is mounted to a rotatable crystal and is rotatable therewith for purposes of setting. The crystal is rotatably mounted on the timepiece housing by means of a slip ring which provides spring pressure against the crystal to hold the crystal in rotatable engagement with a face plate of the housing member and to hold the alarm set ring and slip ring contacts in electrical contact. The slip ring is electrically connected to the internal alarm circuitry. Ridges on the alarm set insulator ring assure the alignment of the alarm set indicator and the tip of the hour hand to insure positive switch contact.

Accordingly, it is an object of this invention to provide a new and improved alarm switch and alarm set device for a timepiece.

Another object of this invention is to provide an alarm set device which includes a rotatable crystal to enable direct manual placement of the alarm set indicator and switch contact.

A further object of the invention is to provide an improved alarm switch and alarm set device having an alarm set insulator ring containing ridges to insure switch contact between the alarm set indicator and switch contact portion of the hour hand.

A further object of this invention is to provide a new and improved alarm switch and alarm set device having electrical connection from the alarm switch mechanism to the alarm noise generator being assured by a slip ring contact, which permits rotation of the entire alarm set indicator and crystal assembly.

A further object of this invention is to provide a new and improved alarm switch and alarm set device comprising a slip ring spring which acts as a movement assembly ring and a spring bias means for providing frictional drag on the crystal to thereby hold the crystal and the alarm set indicator in the manually preset position.

BRIEF DESCRIPTION OF THE DRAWINGS

Other objects and advantages of the present invention may be more clearly seen when viewed in conjunction with the accompanying drawings. Like reference numerals refer to like parts throughout.

DETAILED DESCRIPTION OF THE INVENTION

Figure 1:
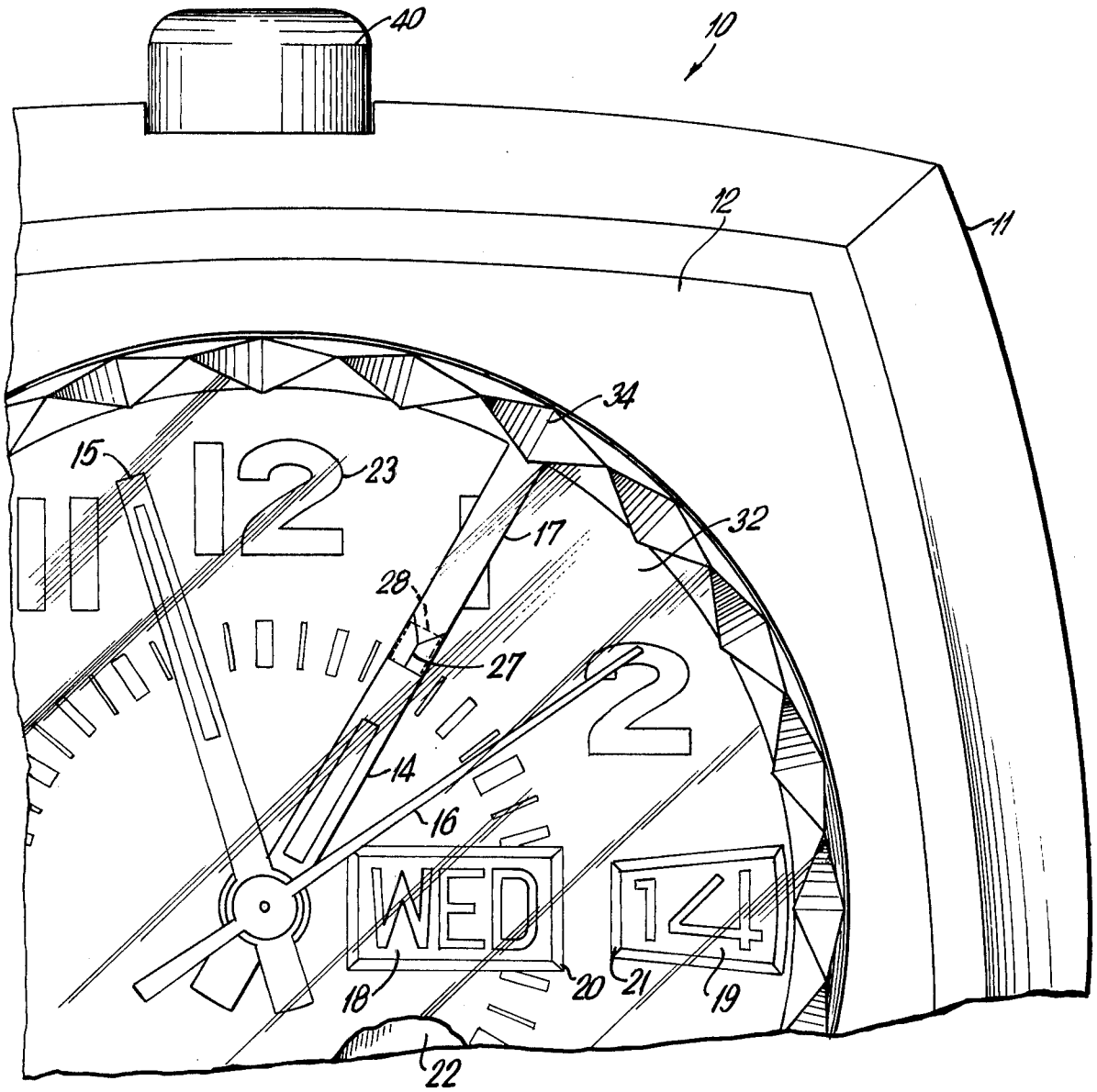
FIG. 1 is a partial top plan view of the face of an alarm clock incorporating the switch arrangement of the present invention.

Referring to the drawings, the invention comprises an electric alarm timepiece 10 which includes an improved alarm switch and alarm set device which will be described in greater detail hereinafter. As shown in FIG. 1, the timepiece 10 may be a clock type timepiece although the invention may be incorporated in other type timepieces. The clock movement (not shown) including the alarm switch and alarm set device are mounted in clock case 11 between the face plate 12 and the clock back 13. The alarm circuit and the alarm or buzzer are not disclosed in detail since they are conventional and any number of different arrangements may be used.

The subject alarm clock 10 of the preferred embodiment includes an hour hand 14, a minute hand 15, and a second hand 16 and in addition an alarm set indicator 17.

In FIG. 1, a day ring 18 and a date ring 19 are visible through windows 20 and 21 respectively in the dial 22. Conventional indicia 23 are mounted about the clock 10 to indicate time in cooperation with the hands 14, 15 and 16. An alarm set insulator ring 24 of transparent material is mounted above the indicia and extends circumferencially about the clock. The insulator ring 24 which may be of plastic material includes inner and outer concentric ridges 25 and 26 which comprise surface portions on the upper surface of the alarm set insulator ring 24. These ridges 25, 26 insure alignment and contact between the hour hand 14 and the alarm set indicator 17.

Figure 2:
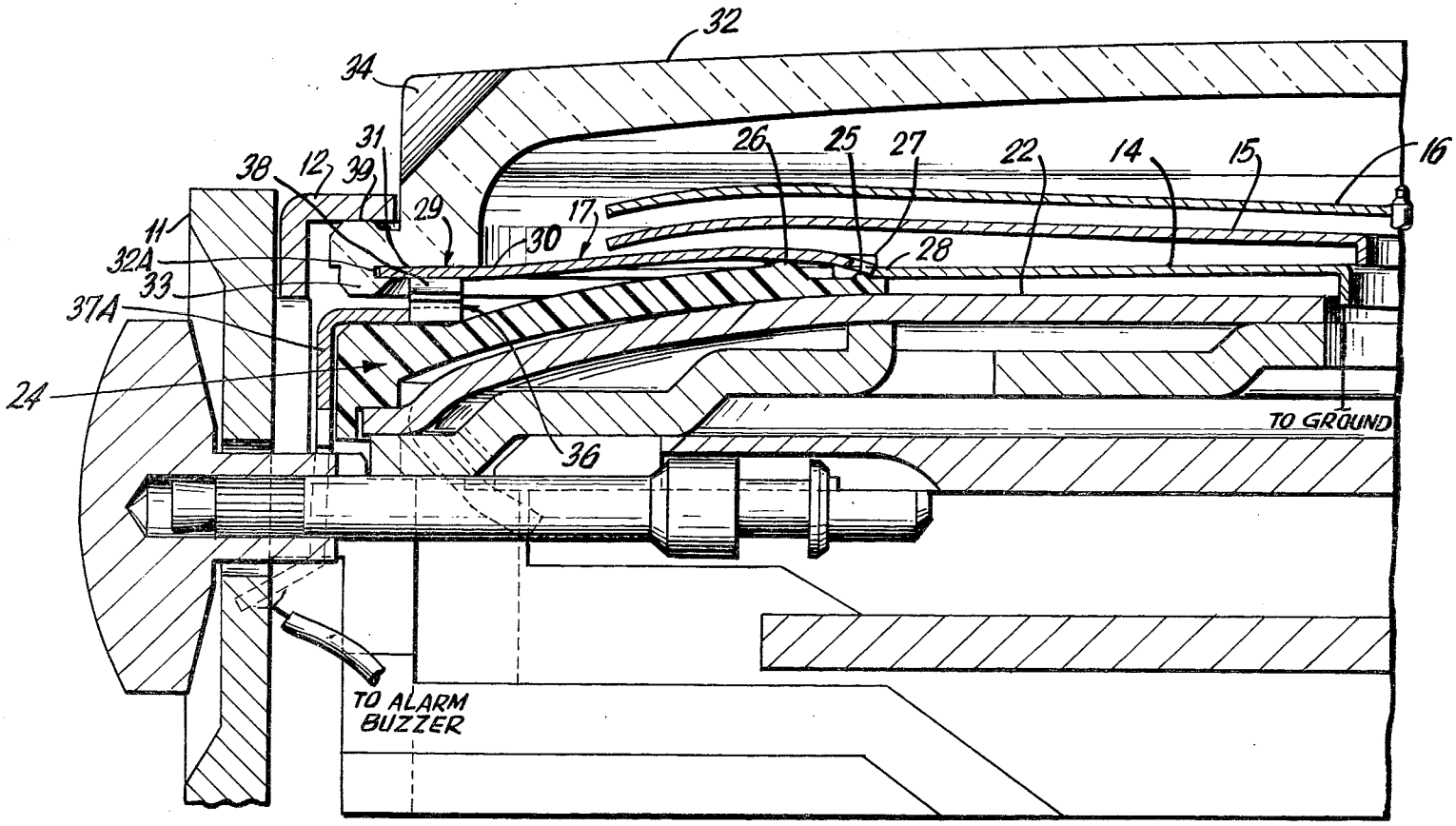
FIG. 2 is a partial cross-sectional view illustrating the cooperating members of the alarm switch and alarm set device.
Figure 3:
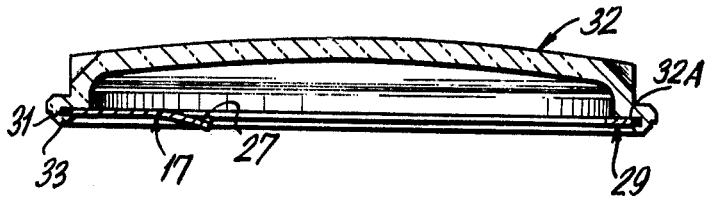
FIG. 3 is a cross-sectional view of the crystal and alarm set indicator ring mounted thereto.
Figure 4A:
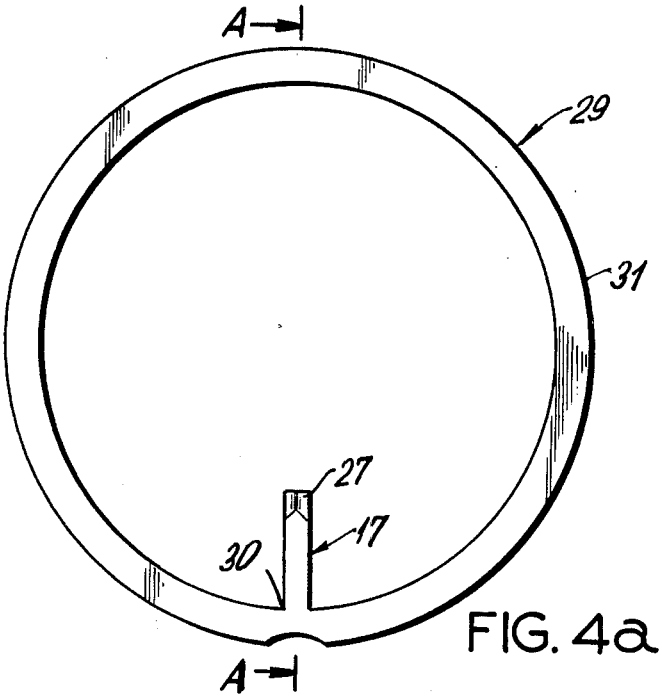
FIGS. 4*a*, 4*b* and 4*c* are a top plan view, a cross-sectional view taken along section A—A of the alarm set indicator ring and an end view of the indicator switch contact portion respectively.
Figure 4B:
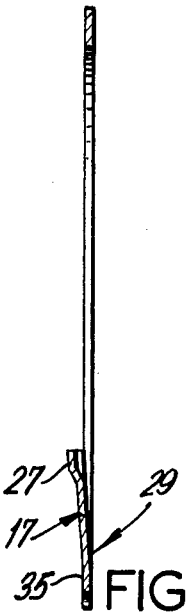
Figure 4C:
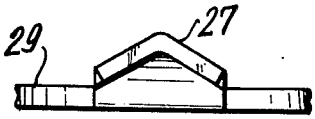
Figure 5A:
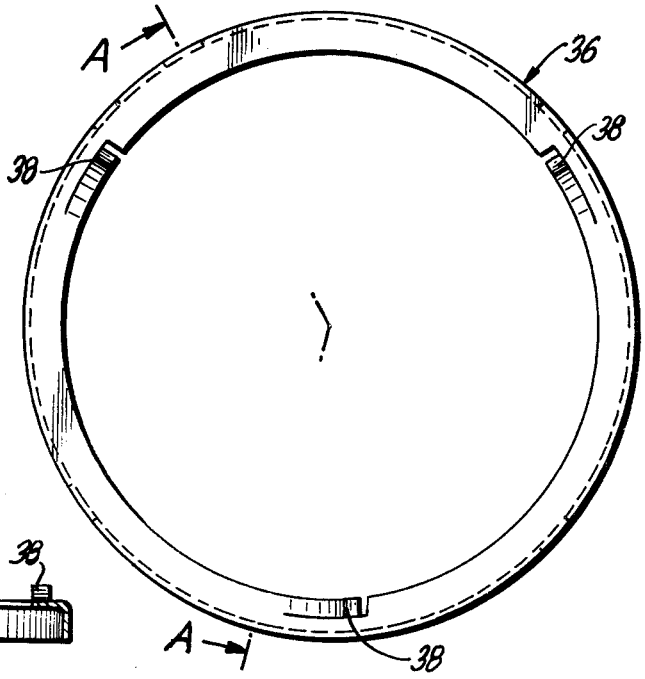
FIGS. 5*a* and 5*b* are a top plan view and a cross-sectional view taken along section A—A of the slip ring contact assembly.
Figure 5B:
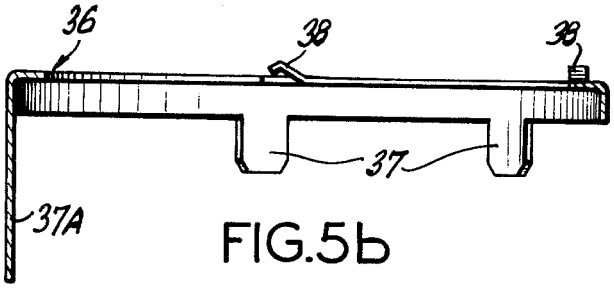

The present invention is designed to provide direct manual positioning of the alarm set (indicator) device, without the need for gear mechanisms, such that when the hour hand 14 engages the alarm set indicator 17, the alarm circuit is activated. As may be seen from FIG. 2, the contact portion 27 of the alarm set indicator 17 is slightly lowered so that contact is established when the main portion of the indicator 17 and the hour hand 14 are aligned. The positive switch contact is provided by formed ridges 25 and 26 on the alarm set insulator ring 24 which guide the tip 28 of the hour hand 14 into engagement with the alarm set indicator 17. The ridges 25 and 26 are extensions of the upper surface of the insulator ring 24. The alarm set indicator 17 is mounted to or forms an extension of the alarm set indicator ring 29 at point 30 and is cantileved outwardly therefrom towards the interior of the watch 10. Positive switch contact is provided by this arrangement over long periods of use thereby ensuring a high degree of reliability in the alarm arrangement.

The alarm set indicator ring 29 includes a body portion or periphery 31 which is affixed, for example, by ultrasonic weld, to the rotatable crystal 32 in a circumferencial crystal retaining slot or cutout 32A. The outer periphery 31 of the ring 29 is held by the crystal projecting ledge portion 33 formed by ultrasonic welding. The crystal 32 and ring 29 are rotated about the clock to set the alarm time by means of the tactile gripping edges or knurled surface portions 34 of the crystal 32.

The alarm time is set by means of manually rotating the crystal to position the alarm set indicator 17 to the desired alarm time.

The alarm set indicator 17 and ring 29 may comprise a unitary stamped electrically conductive metal washer or ring like member having an inwardly directed indicator and switch contact arm member 17. The inwardly formed indicator member 17 is deformed or bent at a point 35 in a downward direction from the plane of the ring member 29 to provide spring bias for positive engagement with the tip 28 of the hour hand 14. The tip portion 27 of the alarm set indicator 17 is provided with a bent or contoured portion to provide smooth engagement between the tip 28 of the hour hand 14 and the tip 27 of the alarm set indicator 17 at the desired time.

The slip ring 36 is mounted between the alarm set insulator 24 and the alarm set indicator ring 29 by means of tabs 37 which extend from the slip ring 36 downward into the body portion of the clock 10 for affixing said ring member in a desired mounted position. The tab 37A of the slip ring 36 also extends into the body portion of the clock and is elongated to serve as an electrical connection with the alarm circuitry. The three spring prongs 38 are equally spaced about the slip ring 36 to electrically engage or contact the alarm set indicator ring 29 and to provide spring bias against the alarm set indicator ring 29 to urge the rotatable crystal against the circumferencial face plate 12 of the case 11 to thereby rotatably mount the crystal 32 to the clock 10. The prongs 38 are formed of resilient metal so as to provide sufficient spring bias to maintain electrical contact with the alarm set indicator ring 29 and provide sufficient spring pressure for urging the crystal 32 against the face plate 12 and thereby provide frictional engagement therewith. The spring bias pressure is therefore selected to enable the crystal 32 to be manually rotated for alarm setting while providing adequate friction between the face plate 12 and a cooperating surface portion 39 of the crystal 32 to maintain the crystal 32 and therefore the alarm set indicator ring 29 at the desired alarm position.

In operation, the rotatable crystal and alarm set indicator ring assembly 29, 32 may be manually rotated by means of the gripping edges 34 of the watch crystal 32, causing the alarm set indicator 17, which is mounted thereto, to be moved to the desired alarm time. When the hour hand 14 reaches the desired alarm time, the tip 28 of the hour hand 14, guided by ridge 25 engages the contact portion 27 of the alarm set indicator 17. If the on-off alarm switch 40 is set for alarm actuation, the alarm circuit is completed/energized for actuating a conventional buzzer arrangement. As mentioned previously, such circuit and buzzer arrangements are conventional and hence have not been described in detail in this specification. Typical arrangements may be seen in the prior art described previously.

While the invention has been described with respect to a preferred embodiment, it should be apparent to those skilled in the art that numerous modifications may be made thereto without departing from the spirit and scope of the invention.

What is claimed:

1. An alarm timepiece including a switch and an alarm time set mechanism to activate an electric alarm circuit at a predetermined time interval comprising:

a manually rotatable crystal;

an hour hand comprising one contact of the switch;

an electrically conductive alarm set ring extending circumferentially about the time piece and affixed to said crystal and rotatable therewith;

an alarm set indicator comprising the other switch contact, said indicator being mounted at one end to the alarm set ring and contacting the hour hand with the other end as said hour hand is rotated into contact therewith;

a slip ring extending circumferentially about the timepiece and having biasing means for engaging the alarm set ring and exerting bias on the alarm set ring for providing spring bias mounting and assembly of the crystal and the alarm set ring inside a housing member by spring pressure against the housing member and for maintaining electrical connection between the alarm set ring and the alarm circuit.

2. An alarm clock including an electric alarm device having a switch and an alarm time set mechanism to activate the alarm circuit at a predetermined time interval comprising:

a case;

a manually rotatable crystal having gripping means at its outer periphery for purposes of rotating said crystal;

an hour hand comprising one contact of the switch;

an electrically conductive alarm set ring extending circumferentially about the clock and affixed to said crystal for rotation therewith including an alarm set indicator extending inwardly from the inner periphery of the alarm set ring for contacting the hour hand with its inner end portion as said hour hand is rotated into contact therewith;

guide means extending circumferentially about the clock and having an inner peripheral guide for guiding the hour hand into positive contact with an end portion of said alarm set indicator;

biasing means for engaging the alarm set ring and exerting spring bias on the alarm set ring for providing spring bias mounting of the crystal and the alarm set ring inside the case and for maintaining electrical connection between the alarm set ring and the alarm circuit.

3. An alarm clock as in claim 2 wherein:

the crystal includes surface deformations about its periphery to be gripped for purposes of alarm time setting.

4. An alarm clock as in claim 2 wherein:

the alarm set indicator ring and alarm set indicator comprise a unitary stamped electrically conductive ring having an outer circumferential periphery contoured for being received within a circumferencial groove in the crystal for mounting thereto.

5. An alarm clock as in claim 2 wherein:

the guide means comprises a transparent electrically insulator ring extending circumferentially about the clock and having raised portions forming a plurality of ridges at the internal end thereof to guide the hour hand into positive contact with the alarm set indicator.

6. An alarm clock as in claim 2 wherein:

the biasing means comprises an electrically conductive slip ring extending circumferentially about the clock and having a plurality of protruding prongs forming spring means for engaging the alarm set ring and exerting spring bias thereto for urging the crystal outwardly against the case for providing spring bias mounting of the crystal and the alarm set ring.

* * * * *